United States Patent [19]

Belge

[11] 3,930,444

[45] Jan. 6, 1976

[54] PRINTING DEVICE FOR IMPRINTING SELECTED CHARACTERS ON A MOVABLE RECORD MEDIUM

[75] Inventor: Dieter Belge, Schwenningen, Germany

[73] Assignee: Carl Valentin GmbH, Schloss Burgberg, Germany

[22] Filed: Feb. 28, 1974

[21] Appl. No.: 446,771

[30] Foreign Application Priority Data

Apr. 25, 1973 Germany ..... 2320791

[52] U.S. Cl. ..... 101/110; 101/45; 101/93.37

[51] Int. Cl.[2] ..... B41J 1/08

[58] Field of Search ..... 101/45, 93.21, 93.22, 93.37–93.42, 101/95, 99, 110; 235/58 P, 60 P

[56] References Cited

UNITED STATES PATENTS

| | | | |
|---|---|---|---|
| 1,909,550 | 5/1933 | Pierce | 101/93.22 X |
| 2,542,658 | 2/1951 | Garbell | 101/93.21 |
| 3,218,966 | 11/1965 | Petit | 101/95 |
| 3,420,165 | 1/1969 | Kohmann | 101/93.37 X |
| 3,669,016 | 6/1972 | Kittel | 101/110 X |
| 3,690,250 | 9/1972 | Bremner et al. | 101/95 |
| 3,824,922 | 7/1974 | Van Auker | 101/45 |

*Primary Examiner*—Edgar S. Burr
*Assistant Examiner*—Edward M. Coven
*Attorney, Agent, or Firm*—Lawrence E. Laubscher

[57] ABSTRACT

A printing device for imprinting selected characters from a plurality of type wheels on a record medium is described. Control means are provided for selectively adjusting each of the type wheels to bring selected characters of each of said type wheels into registry with printing positions on the record medium. The control means includes adjusting or typesetting means for each of said type wheels which are conjointly driven by a common drive means. Means are provided for selectively disengaging the drive means and the adjusting means of any type wheels which have selected characters in registry with the printing position on said record medium. The drive means continues to drive other adjusting means notwithstanding the prior disengagement of other adjusting means from the drive means.

5 Claims, 5 Drawing Figures

PRINTING DEVICE FOR IMPRINTING SELECTED CHARACTERS ON A MOVABLE RECORD MEDIUM

The present invention relates to a printing apparatus for imprinting selected characters on a movable record medium. More specifically the present invention relates to a printing mechanism having a set of juxtaposed type wheels with a plurality of characters thereon and typesetting control means for selectively adjusting said type wheels to bring selected characters thereon into registry with printing positions on the record medium.

DESCRIPTION OF THE PRIOR ART

Printing devices of the general class described above are already known in varied designs. However, all of these designs reveal a complicated control mechanism for the adjustment of the type wheels so that the production costs of such printing devices are correspondingly high.

SUMMARY OF THE INVENTION

It is an object of the present invention to create a printing device which is distinguished, in terms of design, by its particular simplicity and which can be produced at a correspondingly low cost.

It is another object of the present invention to provide a printing device suitable for use with a computer unit of an electrical cash register for the print-out of sales slips, credit slips, or coupons which displays the printed information in a manner that can be documented.

It is still another object of the present invention to provide a printing device for use in combination with electronic scales or any other output instruments which require an information to be printed out on a record medium.

It is a further object of the present invention to provide a printing mechanism which can be used as an independent subsystem having its own drive means.

The objects of the present invention are fulfilled by providing an adjusting or typesetting means for each of said type wheels which can be interrupted independently of the drive motion of the drive members of a control mechanism which drives them. The motion of the drive means remains the same for any adjustments of the type wheels. However, the adjusting means for each type wheel are selectively disengaged from the drive means as selected characters of the associated type wheels reach a printing position. In this design, the adjustment of the type wheels is no longer achieved through a corresponding control of separate control mechanisms bringing about the drive of those wheels but rather by the control device according to the invention which, for this purpose, merely brings about a separation of the mutually cooperating adjusting and drive members, something which can be achieved advantageously in various ways in terms of design.

In a preferred embodiment, the adjusting members comprise toothed racks and the toothed wheels, which serve for the adjustment of the type wheels, and which can selectively be stopped by means of an electrical control device.

The selective separation of the toothed racks and drive members for the selective adjustment of the type wheels can be accomplished in a particularly simple manner by the use of a releasable coupling comprising, which is attached to the toothed rack and which can be pivoted or bent downwardly under the action of traction or pressure, and a pick-up means which is attached to the drive means and releasably engages the coupling means. In a preferred embodiment the stop means comprises an angular spring, such as a wire spring, which has a first leg arranged substantially parallel to the longitudinal axis of the tooth rack to which it is attached and a second leg at an angle to said first leg in the plane of the toothed rack. The pick-up means comprises a laterally movable rod for the purpose of driving all toothed racks which engages between them and their stops. If, upon the action of the control device, corresponding toothed wheels driven by the toothed racks which turn the type wheels are brought to a standstill, this also interrupts the movement of the toothed racks so that a relative motion takes place between the stop means and the rod-shaped pick-up means. This causes the wire spring to pivot or bend down for the purpose of releasing the rod-shaped pick-up means. In order to enable the pick-up means to again grip behind the stop in the original manner on the return stroke of the pick-up means a further improvement of this releasable coupling provides a stop-leg, or second leg, cooperating with the rod-shaped pick-up means, which is bent downwardly at an acute angle for the formation of a third leg, a diagonal run-up curve, at its free end in the plane of the toothed rack which extends away from the stop-leg into the movement plane of the pick-up. As a result of this diagonal run-up curve, a camming effect is achieved when the pick-up rod encounters said third leg on its return stroke. This camming effect causes the stop means and the stop-leg to pivot or bend downwardly so that the pick-up means can move beyond that leg and so that the stop-leg can snap back into its normal position. The toothed wheel means, which cooperate with the toothed racks and which are associated with the individual type wheels, can be arranged coaxially with respect to the type wheels. In that case, the toothed racks would engage between the type wheels and it would accordingly be necessary to accept a comparatively broad interval between the individual type wheels. In order to be able to arrange the type wheels as closely together as possible, the toothed wheels in a preferred embodiment of the present invention are positioned on axes which are substantially parallel to the axes of the type wheels, and preferably below them. The type wheels can be adjusted by an adjusting wheel which can be driven by the toothed wheel means which meshes with the toothed racks. The characters of the type wheels are tip-stretched on the front side of each of a plurality of teeth provided along the circumference of the type wheels. The adjusting wheels mesh with the teeth of the type wheels. This design makes it possible to guide the toothed racks in an area below the type wheels.

The interruption of the adjusting movement of the toothed racks by the electrical control device can advantageously be accomplished by selectively actuated stop-members which engage in the teeth of the particular adjusting wheel. In a preferred design the stop-member is arranged on a magnetically actuated swing lever. Each adjusting wheel has such a swing lever, equipped with a stop-member associated therewith, and the type wheels are arranged closely to each other and the drive and control mechanisms. Accordingly, a plurality of very small electromagnets having coil widths of just a few millimeters are used to drive the stop members. In order now to make sure that there will be a comparatively large starting torque available in spite of such small magnets, at least two or preferably three magnets are provided and arranged in a common plane located perpendicularly with respect to the axis of the swing lever and staggered at angular intervals from each other. Each of the magnets cooperates with a separate arm of the swing lever. According to the invention, the electrical control device for the control of the toothed rack movements includes at least one electric terminal board on which, next to each other, there are arranged a number of contacts, which can be selected by the adjusting device and which correspond to the number of characters present on the type wheels. Associated with this electrical terminal bar there is provided a contact spring which is secured to the toothed racks and which is electrically connected with the magnets of all swing levers. This contact spring picks off the contacts of the contact carrier. The design can be such that a stationary electrical terminal bar is associated with each toothed rack and that accordingly there is also arranged, on each toothed rack, a contact spring which engages the contacts on the electrical terminal board.

BRIEF DESCRIPTION OF THE DRAWINGS

The objects of the present invention and the attendant advantages thereof will become more readily apparent by reference to the following drawings wherein.

DETAILED DESCRIPTION

Figure 1:
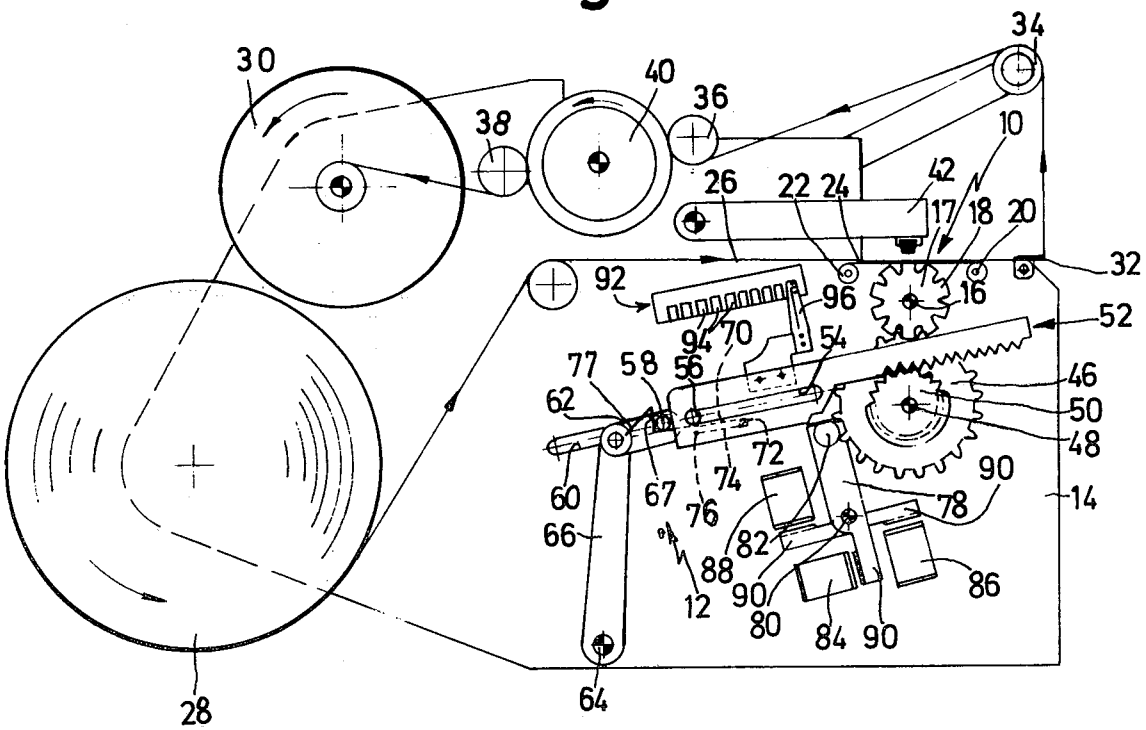
FIG. 1 is a side elevational diagrammatic view of a first embodiment of the printing apparatus of the present invention.

Referring to FIG. 1 there is illustrated, for example, a printing device which can be connected to a cash register or some other piece of equipment. That is to say, the printing mechanism is controlled and driven directly by such a piece of equipment.

The printing device of FIG. 1 includes a printing mechanism generally indicated 10 and a control mechanism generally indicated 12 arranged between two side support plates 14 which are arranged substantially parallel to each other. The printing mechanism includes a plurality of juxtaposed type wheels 17 which are rotatably arranged at closely spaced intervals on a common bearing axle 16 journaled in side plates 14. Along their circumference, type wheels 17 have a plurality of teeth 18 spaced at uniform angular intervals. On their front side, these teeth in each case have printing characters thereon. These characters may consist of letters as well as numbers.

In one example, we might assume that billing amounts, which are put into a cash register with the help of the printing mechanism, are to be printed upon tickets. Accordingly, the type wheels 17 are equipped with a total of ten teeth 18, each of which carries one number. The bearing axle 16 of the type wheel is journaled in an upper plane of the plates 14, whereby the type wheels are covered by a typewriter ribbon which is guided on movable rollers 20, 22. Above that typewriter ribbon and essentially parallel to it there is provided a record medium designated 26 having individual sections. The record medium may be a paper strip drawn from a supply spool 28 which can be wound up on a wind-up spool 30. The paper strip according to FIG. 1 is guided to the right of the type wheels, around a scrape-off edge 32 substantially perpendicularly upward and then around a diversion roller 34 and is thus pressed by two pressure rollers 36, 38 against a part of the circumference of a rotatable transport roller 40. The strip is gradually drawn off from the spool 28 in such a manner that, in each case, an unprinted section of the record medium is fed between the type wheels 17 and a printing hammer 42 which, in turn, for the purpose of pressing the record medium against the typewriter ribbon or against the numbers which are in the printing position, performs a striking motion in the known manner.

To adjust the printing mechanism 10, each type wheel 17 has associated with it an adjusting or typesetting wheel 46. These adjusting wheels sit on a common bearing axle 48 which, according to FIG. 1, is rotatably arranged under the type wheel set and preferably in the plane of bearing axle 16. The adjusting wheels 46 which are made in the form of toothed wheels, are, with their teeth, in form-locking engagement with the tooth gaps of the type wheels 17. The adjusting wheels 46 are for the purpose of their being driven, connected in a torsion-proof fashion with a coaxially arranged drive pinion 50 which, in turn, meshes with a toothed rack 52. The adjusting wheels 46, the pinions 50, and the toothed rack 52 constitute a part of the general control mechanism 12. Individual toothed racks 52 are equipped with a guide slit 54 which extends in the longitudinal direction of said racks and which, for the purpose of toothed rack guidance, cooperates with a guide rod 56 held between side support plates 14. The longitudinal adjustment of the individual toothed racks for the adjustment of the type wheels is accomplished by means of a common pick-up rod 58 which is linearly movable laterally of itself with its ends in the corresponding guide slits 60 of the two plates 14. There is further provided a pair of pick-up arms 62 for each adjusting means, which in each case are articulated swingably at the free end of an adjusting lever 66 which sits on a swing axle 64 and which can be swung back and forth by a suitable drive means (not shown).

Figure 3:
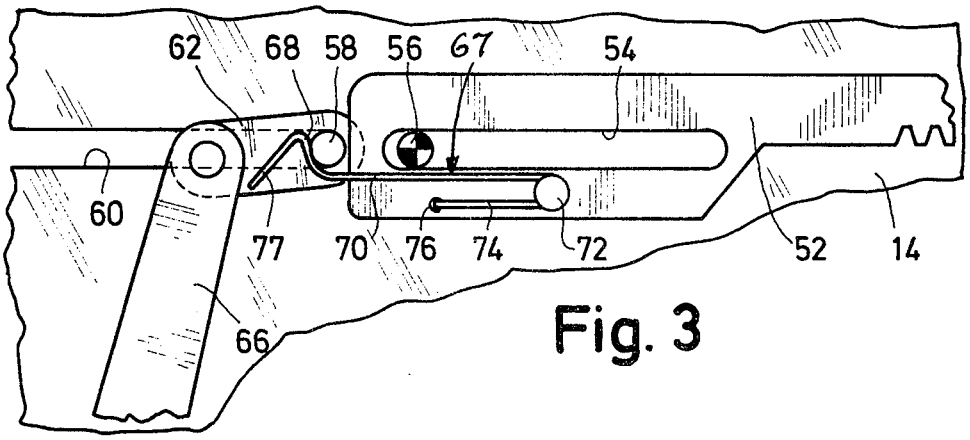
FIGS. 3–5 are detailed views illustrating the operation of the resilient coupling means for connecting the pick-up means with the toothed rack.

To form a drive connection for pick-up rod 58 with the individual toothed racks 52 a resilient coupling 67 (FIG. 3) is provided which can be pivoted or bent between a first and second position under the effect of tension or pressure. Said coupling means is formed by an angular wire spring which is attached at the rear end of the toothed rack 52 and which so to speak forms a stop portion 68 pointing upwardly. The wire spring is bent with a first leg portion 70 around a bracing member 72 which is arranged on the toothed rack at a distance spaced from the rear end of said toothed rack 52 defining a second leg portion 74. This second leg portion 74 extends substantially parallel to the first leg portion 70 in the direction of the toothed rack end and is attached to the tooth rack at 76. As a result of the comparatively long distance between the bracing member 72 and stop leg portion 68, the first leg portion 70 can be bent over a comparatively long distance so that it has a relatively small spring resistance in this area and so that it will give way downwardly at a relatively small pressure exerted by the pick-up rod 58 upon the stop leg portion 68. Therefore, pick-up rod 58 will run over stop leg portion 68 when the associated toothed rack 52 is stopped. Thus toothed rack 52 becomes disconnected and driveless.

The free end of stop leg portion 68 is bent off at an acute angle to form a diagonal run-up curve 77. This spring leg portion extends away from stop leg 68 into the movement plane of the pick-up rod 58. Parts 58, 68 thus create a separable hangon coupling between the drive member 62 and the toothed racks which is disengaged when the type wheels, in the course of their rotation movement brought about by the toothed racks, assume a position in which a selected character is in the printing position.

The movement of the toothed rack must thus be interrupted at a very specific moment in the course of the drive movement of the pick-up rod 58. For this purpose, there is associated with each adjusting wheel 46 a locking lever 78, positioned on a common swing axle 80 arranged parallel to the bearing axle 48 of the adjusting wheels 46. The locking lever 78 on its free end, has a pin-like stop member 82 which engages between a tooth pair of the adjusting wheel and thus brings about the locking or stopping of the same or of the particular type wheel and the corresponding toothed rack. The swinging of the locking lever 78 is facilitated by magnetic force generated by three electro-magnets 84, 86, 88, arranged in a common plane but at angular intervals from each other. With small magnetic coil diameters, said magnets in each case cooperate with an arm 90 of the locking lever 78.

The selection of the magnets is accomplished by means of an electrical control device which, in a preferred embodiment includes for each toothed rack 52, a stationary electrical terminal bar 92 upon which there is arranged a number of contacts 94 which can be selected by the adjusting device and said number corresponds to the number of the characters or numerals present on the type wheels. Associated with this electrical terminal bar there is a contact spring 96 secured to the toothed rack. This contact spring is electrically connected with the magnets of the particular locking lever 78 and selectively engages the contacts 94 during the longitudinal movement of the toothed rack.

DESCRIPTION OF OPERATION

Let us assume that the printing device is not in operation. The control mechanism 12 in this case remains in the position shown in FIG. 1 in which, for example, the number 0 of the individual type wheels 17 is in the printing position opposite the printing hammer 42. Now, if in the connected instrument, for example, an electrical cash register, a certain numerical value is put in, then that same value is directly coded in the control device by virtue of the fact that, on the individual electrical terminal bars 92, voltage is applied to the contact switch in each case corresponding to a number of the numerical value. In order to print the numerical value on a section of the record strip 26, it is necessary to set the control mechanism 12 in motion whereby, due to the swinging of the adjusting levers 66, the pick-up rod 58 simultaneously tries to set all toothed racks in motion through cooperation with their stop leg portions 68. The contact springs 96, attached to the toothed racks respectively, now sweep contacts 94 as the toothed racks are driven and the particular contact to which voltage has been applied. As a result the magnets are selectively energized which leads to the engagement of the locking lever in the associated adjusting wheel 46 and thus the stopping of the type wheels 17 and the corresponding toothed rack 52 (see FIG. 2).

Figure 2:
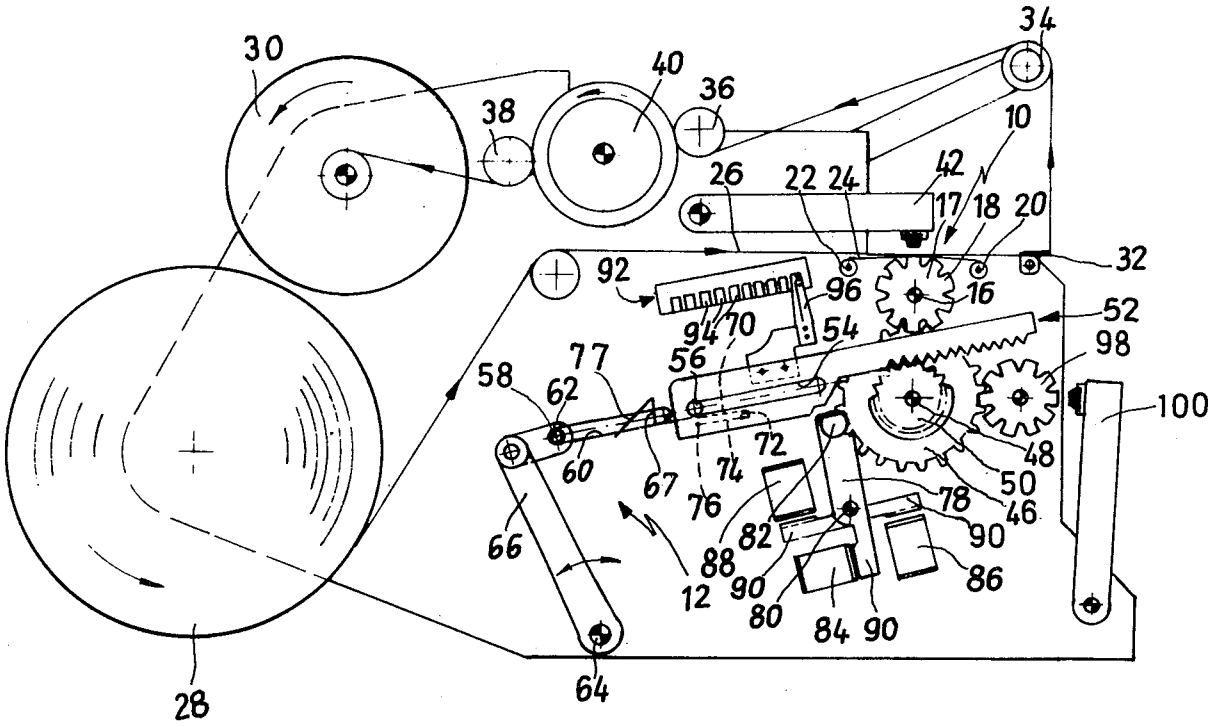
FIG. 2 is a side elevational diagrammatic view of a second embodiment of the printing apparatus of the present invention.
Figure 4:
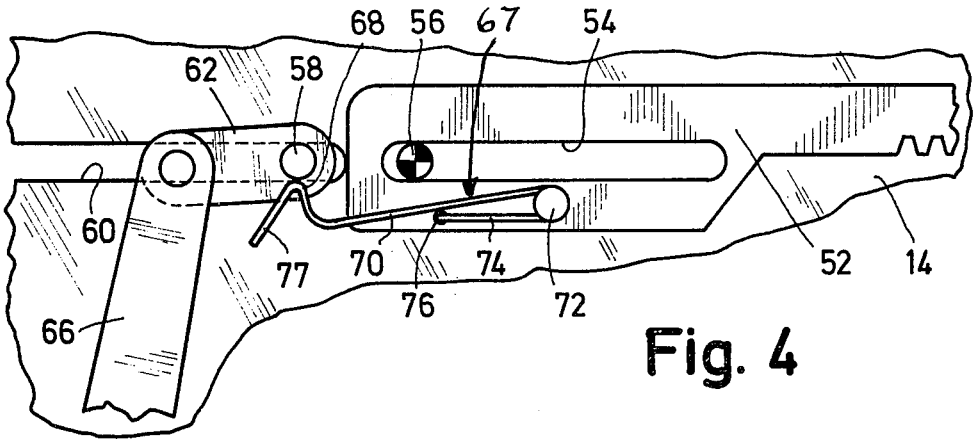
Figure 5:
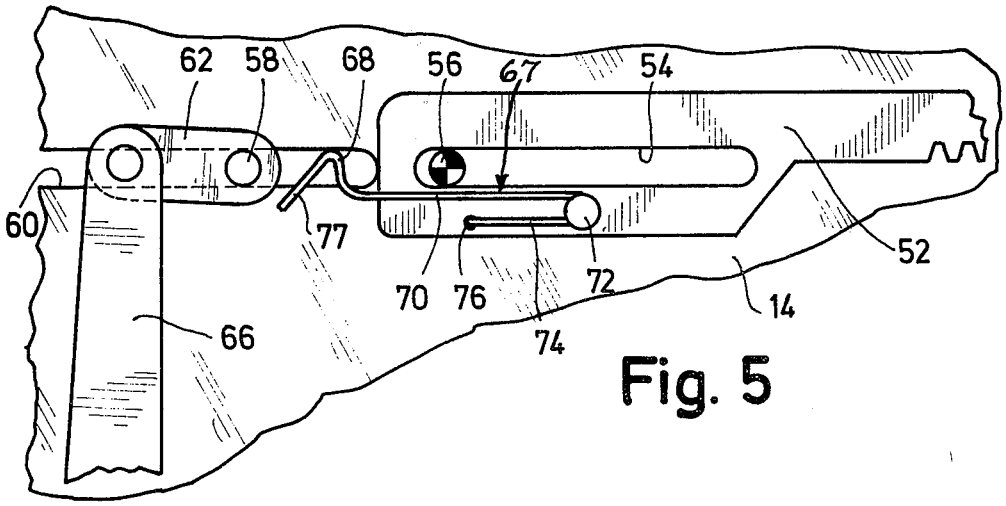

On the basis however of the fact that the pick-up rod 58 performs an equally large adjusting movement for each imprint, the spring leg portion 70 is swung out downward (FIG. 4) by the pressure created between rod 58 and stop leg portion 68 and the toothed rack drive is thus interrupted decoupled whereby the pickup rod 58 moves into a terminal position shown in FIG. 2. Before the pick-up rod 58 is again steered in the opposite direction, the printing hammer 42 is actuated for the imprint to be made.

At this point in time the individual electrical terminal bars to which voltage has been applied through the adjusting device are rendered currentless, so that the locking levers 78, under the action of a return spring not shown in greater detail, will return to their release position. After that, the pick-up rod 58, in the course of its return stroke runs into the run-up curve 77 of the stop leg portion. As a result stop leg portion 68 is again swung out and the pick-up rod 58 can return into its pick-up position between the stop leg portion 68 and toothed racks 52 and can thus guide the toothed racks into the common starting position according to FIG. 1 for the purpose of adjusting the type wheels 17.

The example shown in FIG. 2 differs from the one shown in FIG. 1 inasmuch as each adjusting wheel 46 meshes not only with a type wheel 17 but also with another identical type wheel 98 which, for example, is arranged at a distance of 90° from type wheel 17 to which is likewise associated a printing hammer 100. This additional type wheel 98 facilitates the continuous imprinting of a band-like record medium, such as a daily reference record strip, not shown in any further detail here.

In order to print on a separate paper strip with the printing device of the present invention scrape-off edge 32 may be replaced by a cutting knife for forming separate imprinted strip segments. The design according to the present invention facilitates the use of any desired large number of type wheels and any selected adjustment of any desired number of type wheels, whereby the input process takes place in parallel and the input in the case of numbers can be accomplished selectively according to a Scheme 1 from 10 or the BCD code. OCRA printing is also possible.

The invention described herein may be modified as would occur to one of ordinary skill in the art without departing from the spirit and scope of the present invention.

It is claimed:

1. In a printing apparatus of the type including a plurality of rotatable type wheels (18), typesetting means (52, 50, 46) for rotating each of said type wheels, a cyclically-operable common drive means (58), resilient coupling means (67) releasably connecting said typesetting means with said common drive means, and locking means (78) for locking said type wheels in desired printing positions, thereby to decouple the typesetting means associated with the locked type wheels from said common drive means, thereby allowing the common drive means to complete its cycle, the improvement wherein a. said typesetting means includes a plurality of parallel longitudinally displaceable racks (52) associated with said type wheels, respectively;

b. wherein said drive means comprises a pick-up rod (58) arranged normal to said racks adjacent and spaced from one end thereof, said pick-up rod being alternately laterally displaceable in a direction longitudinally of said rod toward and away from said rack; and c. further wherein said resilient coupling means comprises spring members (67) connected at one end with said racks, respectively, said spring members having at their other ends projection means (68) for extending in coupling engagement behind said rod, said other ends of said spring members being laterally deflectable for decoupling an associated rack from said rod when said locking means is actuated.

2. Apparatus as defined in claim 1, wherein each of said spring members comprises a wire spring member having a first portion (70) extending longitudinally of and connected at one end with the rack member with which it is associated, said spring member including a stop projection portion (68) arranged at the other end of said first portion, said stop projection portion terminating in an angularly arranged ramp portion (77) which causes said stop projection portion to be laterally deflected when said pick-up rod is displaced toward said wire spring member and said rack.

3. Apparatus as defined in claim 2, and further wherein said wire spring member includes a second portion (74) connecting said first spring portion with said rack, said second portion extending around a lateral abutment (72) on said rack and being secured at its free end to said rack.

4. Apparatus as defined in claim 3, and further including rack guide means (54, 56) guiding said racks for longitudinal movement relative to each other.

5. Apparatus as defined in claim 3, and further including rod guide means (60) guiding the ends of said pick-up rod to assure lateral movement of said pick-up rod longitudinally of said racks.

* * * * *